US011200832B2

(12) United States Patent
Luan et al.

(10) Patent No.: US 11,200,832 B2
(45) Date of Patent: Dec. 14, 2021

(54) PIXEL CIRCUIT, DRIVING METHOD THEREOF, AND DISPLAY APPARATUS

(71) Applicants: BOE TECHNOLOGY GROUP CO., LTD., Beijing (CN); HEFEI XINSHENG OPTOELECTRONICS TECHNOLOGY CO., LTD., Hefei (CN)

(72) Inventors: Mengyu Luan, Beijing (CN); Xinfeng Wu, Beijing (CN); Youyuan Hu, Beijing (CN); Xinzhu Wang, Beijing (CN); Fei Li, Beijing (CN); Huihui Li, Beijing (CN); Chengpeng Zhao, Beijing (CN); Bo Mao, Beijing (CN); Kai Yang, Beijing (CN); Zhongsheng Qi, Beijing (CN); Jie Liu, Beijing (CN)

(73) Assignees: HEFEI XINSHENG OPTOELECTRONICS TECHNOLOGY CO., LTD., Hefei (CN); BOE TECHNOLOGY GROUP CO., LTD., Beijing (CN)

( * ) Notice: Subject to any disclaimer, the term of this patent is extended or adjusted under 35 U.S.C. 154(b) by 443 days.

(21) Appl. No.: 16/313,126

(22) PCT Filed: May 24, 2018

(86) PCT No.: PCT/CN2018/088186
§ 371 (c)(1),
(2) Date: Dec. 24, 2018

(87) PCT Pub. No.: WO2019/052218
PCT Pub. Date: Mar. 21, 2019

(65) Prior Publication Data

US 2021/0225254 A1 Jul. 22, 2021

(30) Foreign Application Priority Data

Sep. 14, 2017 (CN) ..... 201710825147.8

(51) Int. Cl.
*G09G 3/20* (2006.01)
*G09G 3/3258* (2016.01)
*G09G 3/3291* (2016.01)

(52) U.S. Cl.
CPC ..... *G09G 3/2092* (2013.01); *G09G 3/3258* (2013.01); *G09G 3/3291* (2013.01);
(Continued)

(58) Field of Classification Search
USPC ..... 345/76
See application file for complete search history.

(56) References Cited

U.S. PATENT DOCUMENTS

2009/0225013 A1* 9/2009 Lee ..... G09G 3/3233 345/80
2020/0273410 A1* 8/2020 Yu ..... G09G 3/3291

FOREIGN PATENT DOCUMENTS

CN 101127181 A 2/2008
CN 102654972 A 9/2012
(Continued)

OTHER PUBLICATIONS

International Search Report and Written Opinion dated Aug. 22, 2018 in PCT/CN2018/088186.
(Continued)

*Primary Examiner* — Ifedayo B Iluyomade
(74) *Attorney, Agent, or Firm* — Syncoda LLC; Feng Ma

(57) ABSTRACT

A pixel circuit is provided. A first terminal and a second terminal of a light-emitting sub-circuit are coupled to a first power supply terminal and a compensation sub-circuit respectively. A short-circuiting sub-circuit is coupled to the first terminal and the second terminal of, and short-circuits under control of a short-circuiting control terminal, the light-emitting sub-circuit. The compensation sub-circuit is coupled to a data voltage terminal, a reference voltage
(Continued)

terminal, and a first electrode and a gate electrode of a driving transistor. The light-emitting sub-circuit emits a light of brightness in a level corresponding to a current flowing therethrough. The compensation sub-circuit loads, based on the data voltage terminal and the reference voltage terminal, a driving voltage related to a threshold voltage of the driving transistor onto the gate electrode of the driving transistor, such that a current flowing through the driving transistor is not influenced by its threshold voltage.

20 Claims, 11 Drawing Sheets

(52) U.S. Cl.
CPC ..... *G09G 2300/0426* (2013.01); *G09G 2320/0233* (2013.01); *G09G 2320/045* (2013.01)

(56) References Cited

FOREIGN PATENT DOCUMENTS

| | | | | |
|---|---|---|---|---|
| CN | 202796001 | * | 3/2013 | ..... G09G 3/3208 |
| CN | 202796001 U | | 3/2013 | |
| CN | 103165080 A | | 6/2013 | |
| CN | 103700346 A | | 4/2014 | |

OTHER PUBLICATIONS

CN First Office Action in Application No. 201710825147.8, dated Dec. 31, 2019.
CN Second Office Action in Application No. 201710825147.8, dated Jul. 7, 2020.

* cited by examiner

PIXEL CIRCUIT, DRIVING METHOD THEREOF, AND DISPLAY APPARATUS

CROSS-REFERENCE TO RELATED APPLICATIONS

The present application claims priority to Chinese Patent Application No. CN 201710825147.8 filed on Sep. 14, 2017, the disclosure of which is hereby incorporated by reference in its entirety.

TECHNICAL FIELD

The present disclosure relates to the field of pixel circuit technologies, particularly relates to a pixel circuit, its driving method and a display apparatus.

BACKGROUND

In a pixel circuit of an organic light-emitting diode (OLED) display panel, the current flowing therethrough is controlled by the driving voltage loaded onto the gate electrode of the driving transistor. As a result, the light-emitting diode can emit a light according to the level of brightness that is needed.

However, the current of the driving transistor is also related to a threshold voltage Vth of the driving transistor, and the threshold voltage can drift as time passes.

SUMMARY

In a first aspect, the present disclosure provides a pixel circuit.

The pixel circuit includes a driving transistor, a light-emitting sub-circuit, a short-circuiting sub-circuit, and a compensation sub-circuit. A first terminal and a second terminal of the light-emitting sub-circuit are electrically coupled to a first power supply terminal and the compensation sub-circuit respectively. The short-circuiting sub-circuit is electrically coupled to the first terminal and the second terminal of the light-emitting sub-circuit, and is configured to short-circuit the light-emitting sub-circuit under control of a short-circuiting control terminal. The compensation sub-circuit is electrically coupled to a data voltage terminal, a reference voltage terminal, and a first electrode and a gate electrode of the driving transistor. A second electrode of the driving transistor is electrically coupled to a second power supply terminal.

In the pixel circuit described above, the light-emitting sub-circuit is configured to emit a light of brightness in a level corresponding to a current flowing therethrough, and the compensation sub-circuit is configured, based on the data voltage terminal and the reference voltage terminal, to load a driving voltage related to a threshold voltage of the driving transistor onto the gate electrode of the driving transistor, such that a current flowing through the driving transistor is not influenced by the threshold voltage of the driving transistor.

According to some embodiments of the pixel circuit, the short-circuiting sub-circuit comprises a short-circuiting transistor. A gate electrode, a first electrode and a second electrode of the short-circuiting transistor are electrically coupled to the short-circuiting control terminal, the first terminal, and the second terminal of the light-emitting sub-circuit, respectively. The short-circuiting transistor is configured to electrically conduct the first terminal and the second terminal of the light-emitting sub-circuit upon a turning-on signal from the short-circuiting control terminal.

According to some embodiments of the pixel circuit, the compensation sub-circuit comprises a storage capacitor, a writing portion, and a reading portion. A first electrode and a second electrode of the storage capacitor are electrically coupled to the writing portion and the gate electrode of the driving transistor, respectively. The writing portion is electrically coupled to the data voltage terminal and the reference voltage terminal, and the writing portion is configured to guide a signal from the data voltage terminal, and to guide a signal from the reference voltage terminal, to the first electrode of the storage capacitor. The reading portion is electrically coupled to the second electrode of the storage capacitor, the first electrode of the driving transistor, and the second terminal of the light-emitting sub-circuit, and the reading portion is configured to electrically conduct the first electrode of the driving transistor with the second terminal of the light-emitting sub-circuit, and to electrically conduct the first electrode of the driving transistor with the second electrode of the storage capacitor.

In some embodiments of the pixel circuit described above, the writing portion can include a first transistor and a second transistor. The first transistor is arranged such that a gate electrode, a first electrode and a second electrode thereof are electrically coupled to a first control terminal, the data voltage terminal, and the first electrode of the storage capacitor respectively, and the first transistor is configured to electrically conduct the data voltage terminal the first electrode of the storage capacitor upon a turning-on signal from the first control terminal. The second transistor is arranged such that a gate electrode, a first electrode and a second electrode thereof are electrically coupled to a second control terminal, the first electrode of the storage capacitor, and the reference voltage terminal respectively, and the second transistor is configured to electrically conduct the reference voltage terminal and the first electrode of the storage capacitor upon a turning-on signal from the second control terminal.

In some embodiments of the pixel circuit described above, the reading portion can include a third transistor and a fourth transistor. The third transistor is arranged such that a gate electrode, a first electrode and a second electrode thereof are electrically coupled to a third control terminal, the second terminal of the light-emitting sub-circuit, and the first electrode of the driving transistor respectively, and the third transistor is configured to electrically conduct the second terminal of the light-emitting sub-circuit, and the first electrode of the driving transistor upon a turning-on signal from the third control terminal. The fourth transistor is arranged such that a gate electrode, a first electrode and a second electrode thereof are electrically coupled to a fourth control terminal, the second electrode of the storage capacitor, and the first electrode of the driving transistor respectively, and the fourth transistor is configured, upon a turning-on signal from the fourth control terminal, to electrically conduct the second electrode of the storage capacitor and the first electrode of the driving transistor to thereby electrically conduct the gate electrode and the first electrode of the driving transistor.

According to some embodiments of the pixel circuit, the compensation sub-circuit further comprises a holding capacitor. A first electrode and a second electrode of the holding capacitor are electrically coupled to the first electrode of the storage capacitor and a ground terminal respectively.

In any one of the embodiments of the pixel circuit as described above, the driving transistor can be a N-type transistor.

In any one of the embodiments of the pixel circuit as described above, each of the short-circuiting sub-circuit and the compensation sub-circuit can comprise at least one transistor. Each of the at least one transistor can be of a substantially same type, and can be, for example, a N-type transistor.

In any one of the embodiments of the pixel circuit as described above, the second power supply terminal can be grounded.

In any one of the embodiments of the pixel circuit as described above, the light-emitting sub-circuit can comprise an organic light-emitting diode (OLED).

In a second aspect, the present disclosure further provides a method for driving a pixel circuit. The pixel circuit can be based on the embodiments as described above.

The method comprises a compensation stage and a writing-and-illuminating stage. During the compensation stage, the short-circuiting sub-circuit is turned on so that the light-emitting sub-circuit is short-circuited and thereby cannot emit a light. During the writing-and-illuminating stage, the short-circuiting sub-circuit is turned off so that the light-emitting sub-circuit can emit a light, and the gate electrode of the driving transistor is loaded with the driving voltage such that the current flowing therethrough is not influenced by the threshold voltage of the driving transistor.

According to some embodiments of the method, the short-circuiting sub-circuit comprises a short-circuiting transistor, arranged such that a gate electrode, a first electrode and a second electrode thereof are electrically coupled to the short-circuiting control terminal, the first terminal and the second terminal of the light-emitting sub-circuit respectively, and configured to electrically conduct the first terminal and the second terminal of the light-emitting sub-circuit upon a turning-on signal from the short-circuiting control terminal. As such, the compensation stage comprises a step of providing the turning-on signal to the short-circuiting control terminal, and the writing-and-illuminating stage comprises a step of providing a turning-off signal to the short-circuiting control terminal.

According to some embodiments of the method, the compensation sub-circuit comprises a storage capacitor, a writing portion, and a reading portion, wherein a first electrode and a second electrode of the storage capacitor are electrically coupled to the writing portion and the gate electrode of the driving transistor respectively, the writing portion is electrically coupled to the data voltage terminal and the reference voltage terminal, and the reading portion is electrically coupled to the second electrode of the storage capacitor, the first electrode of the driving transistor and the second terminal of the light-emitting sub-circuit.

As such, the compensation stage can comprise a resetting sub-stage and a testing sub-stage. The resetting sub-stage can comprise: electrically decoupling the data voltage terminal to the first electrode of the storage capacitor, electrically conducting the reference voltage terminal to the first electrode of the storage capacitor, electrically conducting the first electrode of the driving transistor with the second terminal of the light-emitting sub-circuit, and electrically conducting the first electrode of the driving transistor with the second electrode of the storage capacitor. The testing sub-stage can comprise: electrically decoupling the data voltage terminal to the first electrode of the storage capacitor, electrically conducting the reference voltage terminal to the first electrode of the storage capacitor, electrically decoupling the first electrode of the driving transistor with the second terminal of the light-emitting sub-circuit, and electrically conducting the first electrode of the driving transistor with the second electrode of the storage capacitor;

The writing-and-illuminating stage can comprise a writing sub-stage and an illuminating stage. The writing sub-stage can comprise: electrically conducting the data voltage terminal to the first electrode of the storage capacitor, electrically decoupling the reference voltage terminal to the first electrode of the storage capacitor, electrically conducting the first electrode of the driving transistor with the second terminal of the light-emitting sub-circuit, and electrically decoupling the first electrode of the driving transistor with the second electrode of the storage capacitor. The illuminating stage can comprise: electrically decoupling the data voltage terminal or the reference voltage terminal to the first electrode of the storage capacitor, electrically decoupling the reference voltage terminal to the first electrode of the storage capacitor, electrically conducting the first electrode of the driving transistor with the second terminal of the light-emitting sub-circuit, and electrically decoupling the first electrode of the driving transistor with the second electrode of the storage capacitor.

In the embodiments of the method described above, the writing portion can comprise a first transistor and a second transistor, wherein the first transistor is arranged such that a gate electrode, a first electrode and a second electrode thereof are electrically coupled to a first control terminal, the data voltage terminal, and the first electrode of the storage capacitor respectively, and is configured to electrically conduct the data voltage terminal the first electrode of the storage capacitor upon a turning-on signal from the first control terminal; and the second transistor is arranged such that a gate electrode, a first electrode and a second electrode thereof are electrically coupled to a second control terminal, the first electrode of the storage capacitor, and the reference voltage terminal respectively, and is configured to electrically conduct the reference voltage terminal and the first electrode of the storage capacitor upon a turning-on signal from the second control terminal.

As such, the electrically conducting the data voltage terminal to the first electrode of the storage capacitor can comprise: providing a turning-on signal to the first control terminal; the electrically decoupling the data voltage terminal to the first electrode of the storage capacitor can comprise: providing a turning-off signal to the first control terminal; the electrically conducting the reference voltage terminal to the first electrode of the storage capacitor can comprise: providing the turning-on signal to the second control terminal; and the electrically decoupling the reference voltage terminal to the first electrode of the storage capacitor can comprise: providing a turning-off signal to the second control terminal.

In the embodiments of the method described above, the reading portion can comprise a third transistor and a fourth transistor, wherein the third transistor is arranged such that a gate electrode, a first electrode and a second electrode thereof are electrically coupled to a third control terminal, the second terminal of the light-emitting sub-circuit, and the first electrode of the driving transistor respectively, and is configured to electrically conduct the second terminal of the light-emitting sub-circuit, and the first electrode of the driving transistor upon a turning-on signal from the third control terminal, and the fourth transistor is arranged such that a gate electrode, a first electrode and a second electrode thereof are electrically coupled to a fourth control terminal, the second electrode of the storage capacitor, and the first electrode of the driving transistor respectively, and is configured, upon a turning-on signal from the fourth control terminal, to electrically conduct the second electrode of the storage capacitor and the first electrode of the driving transistor to thereby electrically conduct the gate electrode and the first electrode of the driving transistor.

As such, the electrically conducting the first electrode of the driving transistor with the second terminal of the light-emitting sub-circuit can comprise: providing the turning-on signal to the third control terminal; the electrically decoupling the first electrode of the driving transistor with the second terminal of the light-emitting sub-circuit can comprise: providing a turning-off signal to the third control terminal; the electrically conducting the first electrode of the driving transistor with the second electrode of the storage capacitor can comprise: providing the turning-on signal to the fourth control terminal; and the electrically decoupling the first electrode of the driving transistor with the second electrode of the storage capacitor can comprise: providing a turning-off signal to the fourth control terminal.

In a third aspect, the disclosure further provides a display apparatus. The display apparatus can comprise a pixel circuit according to any one of the embodiments as described above.

BRIEF DESCRIPTION OF DRAWINGS

In order to clearly illustrate the embodiments in the present disclosure, the accompanying drawings that need to be used in the description of the embodiments will be introduced briefly.

Apparently, the following accompanying drawings are just some embodiments of the present disclosure, for those skilled in the art, they can acquire other accompanying drawings based on structures shown in these accompanying drawings on the premise of not paying creative labor.

In combination with the above embodiments of the disclosure as described above, the achievement of objects, the functional characteristics and the advantages of the present disclosure will be further described in detail with reference to the accompanying drawings.

DETAILED DESCRIPTION

Various embodiments of the present disclosure are described below with specific examples, and other advantages and effects of the present disclosure can be easily understood by those skilled in the field of technology from the contents disclosed in this specification.

Apparently, the described embodiments are only a part of embodiments in the present disclosure, rather than all of them. The present disclosure can also be implemented or applied through different specific embodiments, and various details of the specification can also be modified or changed based on different viewpoints and applications without departing from the spirit of the present disclosure.

Based on the embodiments in the present disclosure, all the other embodiments acquired by those skilled in the art on the premise of not paying creative labor are in the protection scope of the present disclosure. It should be noted that, on the premise that there is no conflict, the following embodiments and the features in the embodiments can be combined.

In a pixel circuit of an organic light-emitting diode (OLED) display panel, in order to compensate for the drift of the threshold voltage of the driving transistor, threshold voltage compensation is needed. In current technologies, a typical compensation approach is by means of internal compensation. That is, the pixel circuit is designed in a way such that the threshold voltage is added into the driving voltage.

Figure 1A:
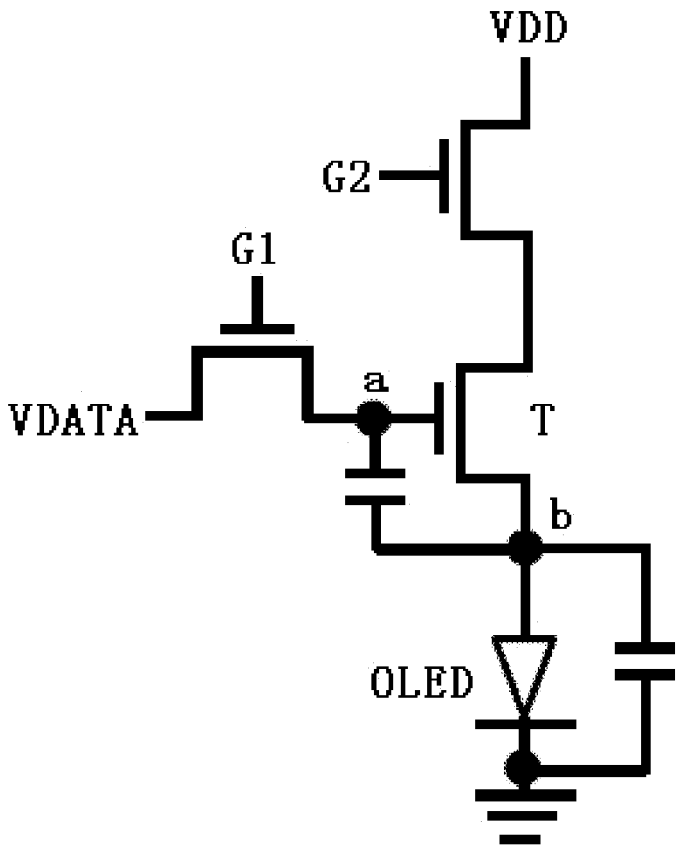
FIG. 1A (Prior Art)
FIG. 1A is a circuit diagram of a pixel circuit according to an existing technology.
Figure 1B:
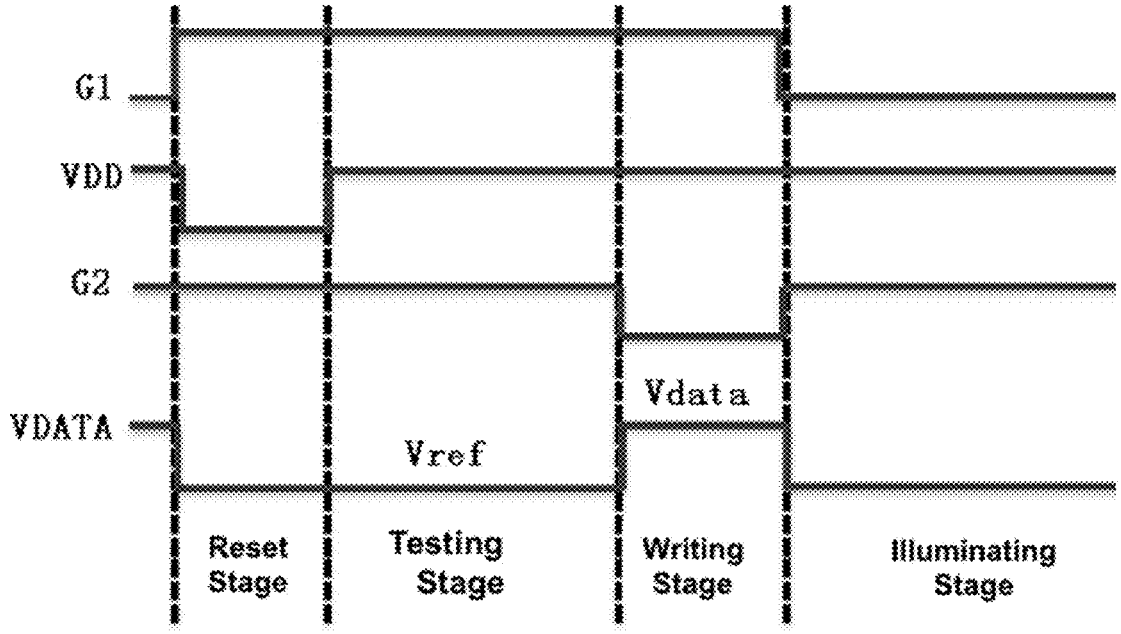
FIG. 1B (Prior Art)
FIG. 1B is a driving time sequence diagram of the pixel circuit as illustrated in FIG. TA.

One example of a pixel circuit according to one existing technology is illustrated in FIG. 1A, and a diagram of a driving time sequence of a first gate line terminal G1, a second gate line terminal G2, a first power supply terminal VDD, and a data voltage terminal VDATA as shown in FIG. 1 during each stage (i.e. the reset stage, the testing stage, the writing stage, and the illuminating stage) is illustrated in FIG. 1B.

As can be seen in FIG. 1A and FIG. 1B, during the testing stage of the pixel circuit according to the existing technology, the voltage at point b:

$$Vb = V\text{ref} - Vth.$$

At this time, Vb must be smaller than the turning-on voltage Voled of the organic light-emitting diode OLED so that the organic light-emitting diode OLED cannot be turned on ahead of time. As such, $$V\text{ref} - V\text{oled} < Vth.$$

Because Vref and Voled are both predetermined values, thus if the drift of the threshold voltage is relatively large, the aforementioned formulas are not valid. As a result, the pixel circuit is not able to work properly.

In other words, the range of compensation for the threshold voltage of the driving transistor according to the compensation approach as described above (i.e. the internal compensation method) is limited in existing pixel circuits in the organic light-emitting diode (OLED) display panels.

In light of the aforementioned limitations of the current compensation approach according to existing OLED display technologies, the present disclosure provides a pixel circuit, a method for driving the pixel circuit, and a display apparatus comprising the pixel circuit.

In a first aspect, a pixel circuit is provided in the present disclosure.

Figure 2A:
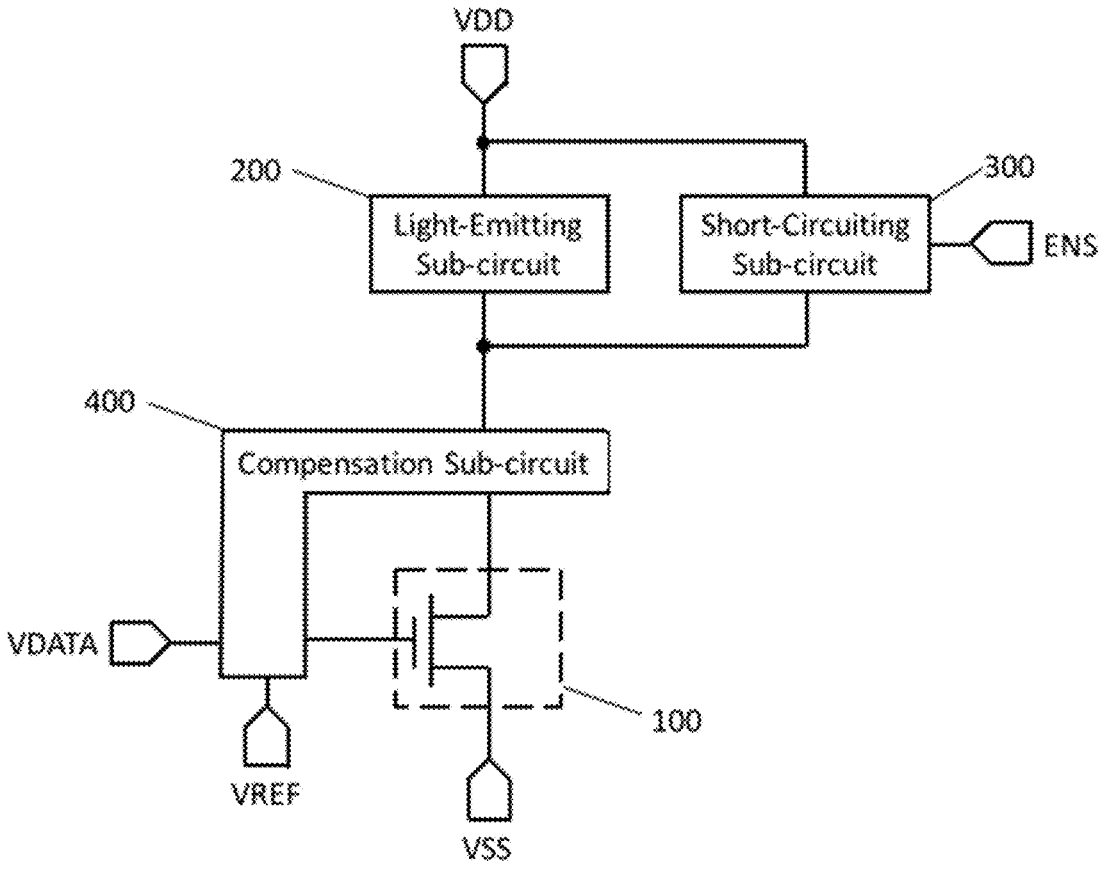
FIG. 2A is a schematic diagram of a pixel circuit according to some embodiments of the present disclosure.

FIG. 2A illustrates a schematic diagram of a pixel circuit according to some embodiments of the present disclosure.

As shown in the figure, the pixel circuit comprise a driving transistor 100 (encircled in a box having dotted lines), a light-emitting sub-circuit 200, a short-circuiting sub-circuit 300, and a compensation sub-circuit 400.

In the pixel circuit, the light-emitting sub-circuit 200 is electrically coupled to a first power supply terminal VDD and to the compensation sub-circuit 400. The short-circuiting sub-circuit 300 is electrically coupled to two terminals of the light-emitting sub-circuit 200, and is further electrically coupled to a short-circuiting control terminal ENS.

The compensation sub-circuit 400 is electrically coupled to a first electrode and a gate electrode of the driving transistor 100 (as indicated by the box with dotted lines in FIG. 3), and is further electrically coupled to a data voltage terminal VDATA and a reference voltage terminal VREF. A second electrode of the driving transistor 100 is electrically coupled to a second power supply terminal VSS.

The light-emitting sub-circuit 200 is configured to emit a light of brightness in a level corresponding to a current flowing therethrough. The short-circuiting sub-circuit 300 is configured to short-circuit the two terminals of the light-emitting sub-circuit 200 under control of a short-circuiting control terminal ENS.

The compensation sub-circuit 400 is configured, based on the data voltage terminal VDATA and the reference voltage terminal VREF, to load a driving voltage that is related to a threshold voltage of the driving transistor 100 onto the gate electrode of the driving transistor 100, such that the current flowing through the driving transistor 100 is not related to the threshold voltage of the driving transistor 100, to thereby eliminate drifting of the threshold voltage of the driving transistor 100.

Herein, the light-emitting sub-circuit 200 can include an organic light-emitting diode OLED. For example, a first electrode of the organic light-emitting diode OLED is electrically coupled to the first power supply terminal VDD, and a second electrode of the organic light-emitting diode OLED is electrically coupled to the compensation sub-circuit 400. In other words, an organic light-emitting diode OLED can be arranged as the light-emitting sub-circuit 200 of the pixel circuit disclosed herein, and thus the pixel circuit as described above can be considered as an organic light-emitting diode (OLED) pixel circuit.

Among all light-emitting electronic components that emit lights in response to the electric currents that flow therethrough, organic light-emitting diodes (OLED) are most common and the technologies related to OLED are also most advanced at the current time. Therefore, the pixel circuit as provided here in the present disclosure can be best employed in the organic light-emitting diodes (OLED). It is noted, however, that the pixel circuit can be applied to other current-based electronic components as well.

In the pixel circuit as described above, the short-circuiting sub-circuit 300 is configured to short-circuit the light-emitting sub-circuit 200 during a compensation stage of the pixel circuit. As such, no matter how the voltages at each point/node is changed during the compensation stage of the pixel circuit, the light-emitting sub-circuit 200 does not emit light. Thereby, the range of compensation of the pixel circuit is not limited, and the drifting of the threshold voltage of the driving transistor 100 can be eliminated.

Figure 3A:
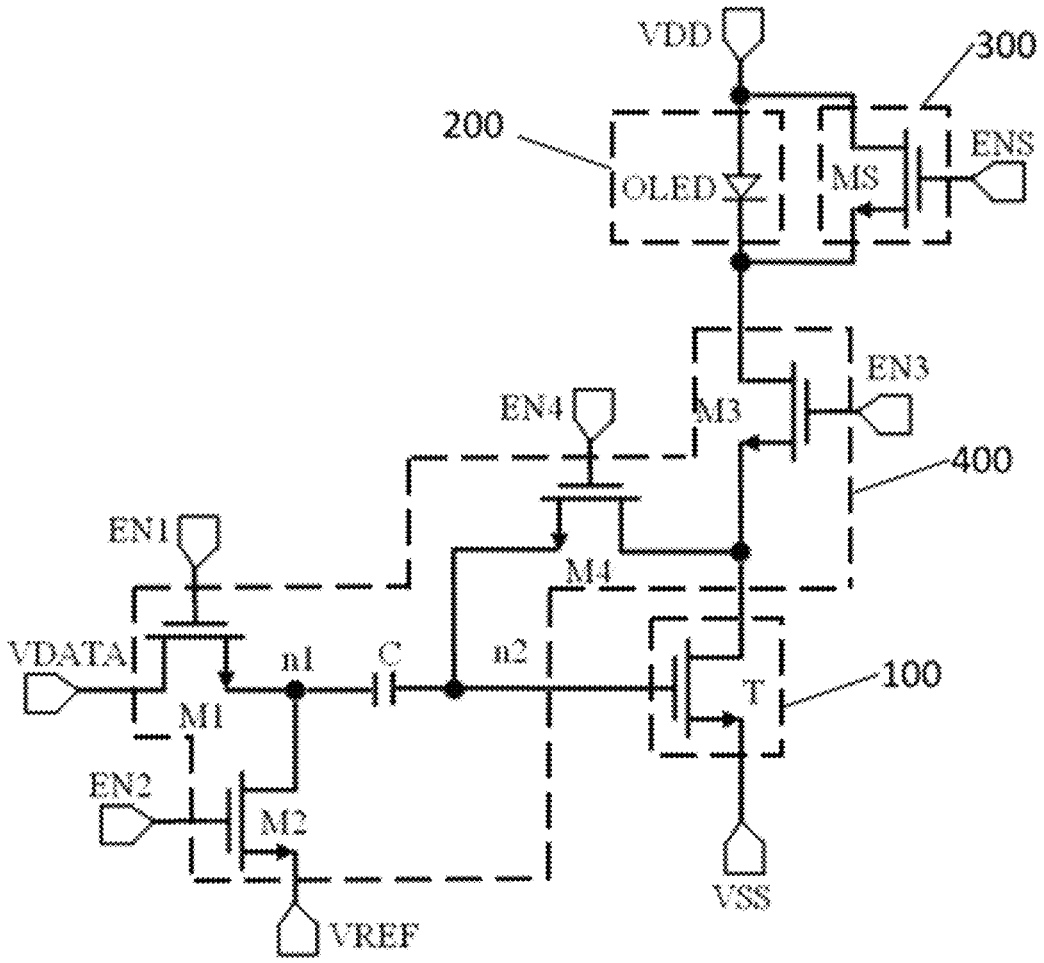
FIG. 3A is a circuit diagram of a pixel circuit according to one specific embodiment of the present disclosure.
Figure 3B:
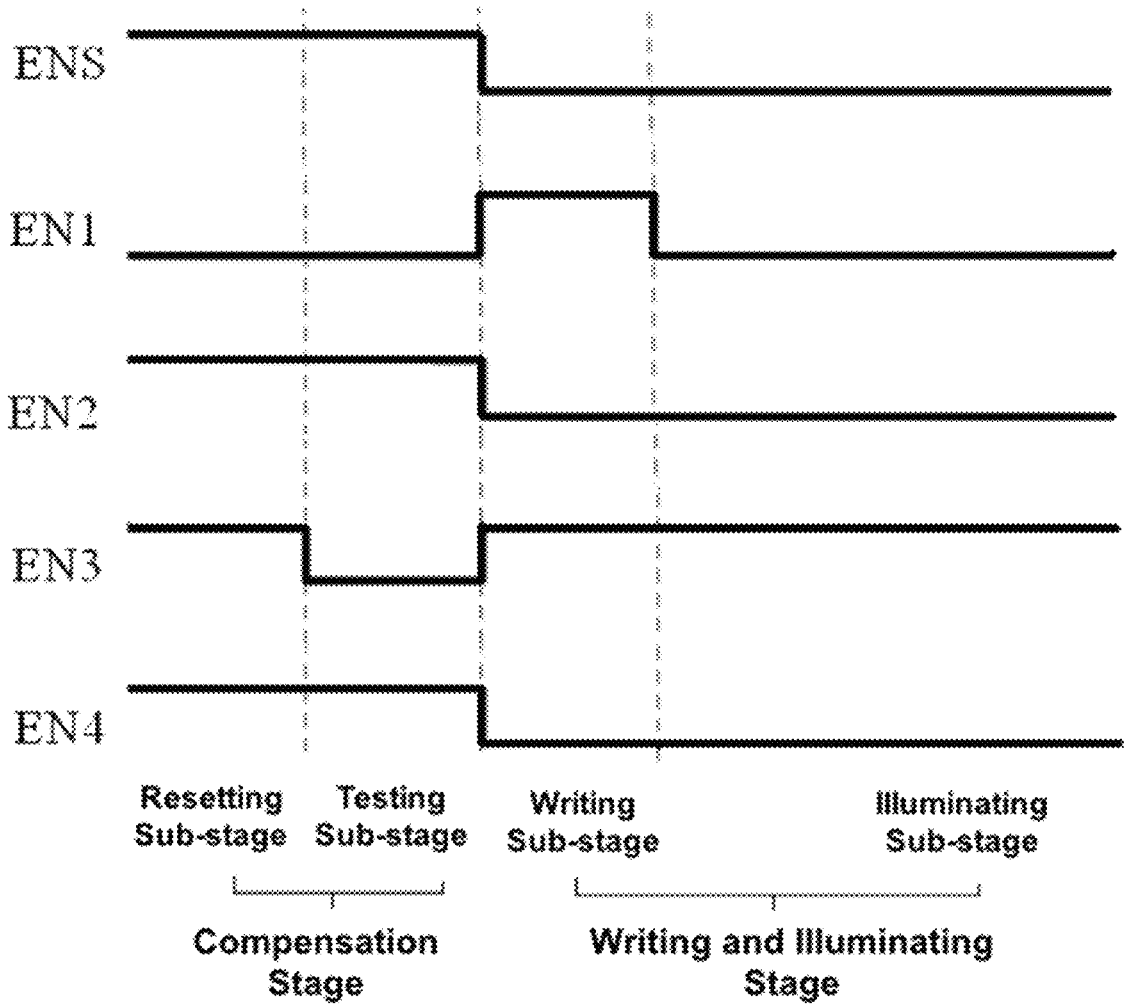
FIG. 3B is a driving time sequence diagram of the pixel circuit as illustrated in FIG. 3A.
Figure 4:
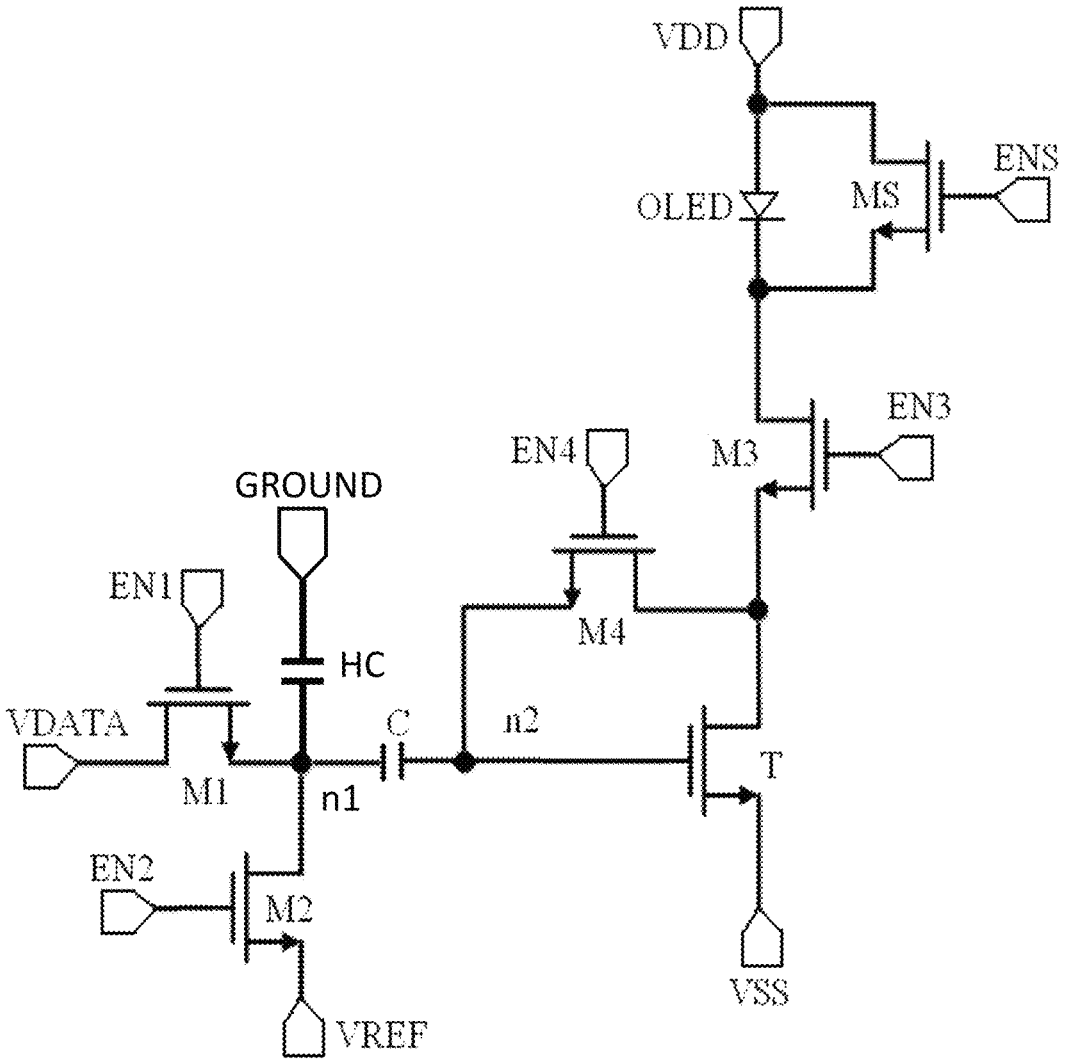
FIG. 4 is a circuit diagram of a pixel circuit according to another embodiment of the present disclosure.

Herein, the short-circuiting sub-circuit 300 can comprise a transistor, configured such that a gate electrode thereof is electrically coupled to the short-circuiting control terminal ENS, and that the other two electrodes thereof are electrically coupled to the two terminals of the light-emitting sub-circuit 200, as illustrated in the specific embodiments shown in FIG. 3A, FIG. 3B, and FIG. 4 that follow.

Figure 2B:
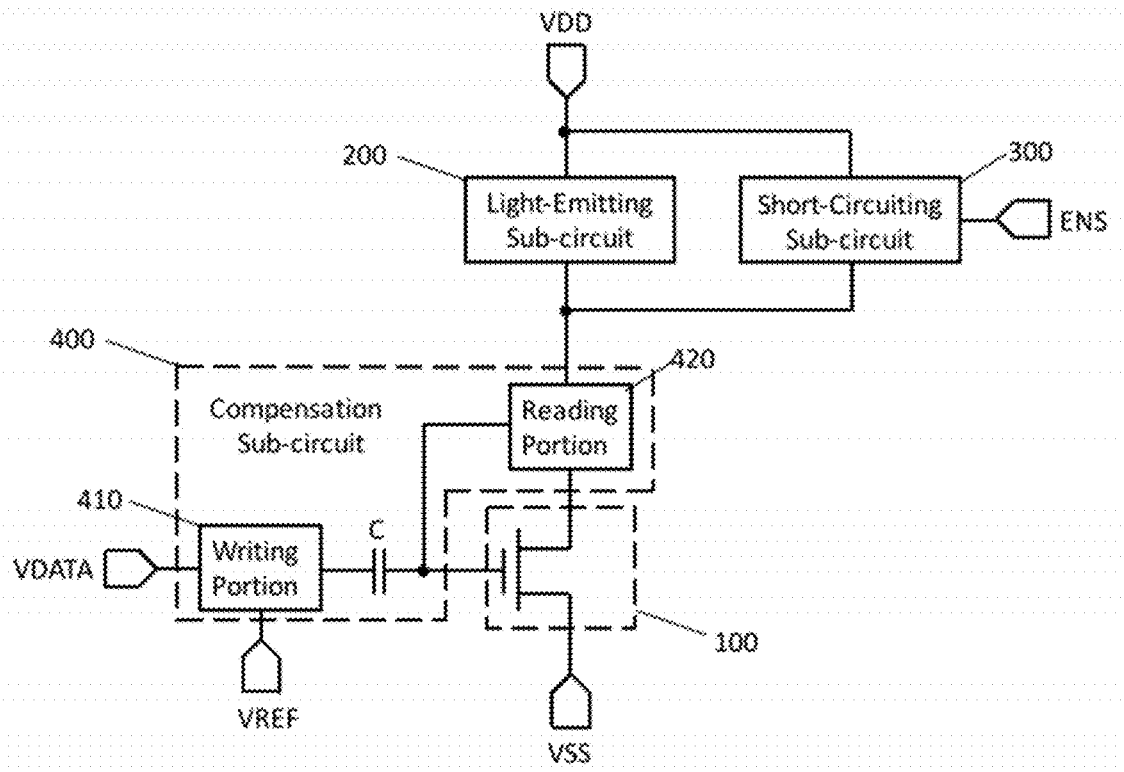
FIG. 2B is a schematic diagram of a pixel circuit according to some embodiments of the present disclosure.

In the pixel circuit, the compensation sub-circuit 400 can include a storage capacitor C, a writing portion 410, and a reading portion 420, as illustrated in FIG. 2B. A first electrode of the storage capacitor Cis electrically coupled to the writing portion 410, and a second electrode of the storage capacitor C is electrically coupled to the gate electrode of the driving transistor 100.

The writing portion 410 is electrically coupled to the data voltage terminal VDATA and a reference voltage terminal VREF respectively, and the writing portion 410 is configured to guide a signal from the data voltage terminal VDATA to the first electrode of the storage capacitor C during a writing and illuminating stage of the pixel circuit, and/or to guide a signal from the reference voltage terminal VREF to the first electrode of the storage capacitor C during the compensation stage of the pixel circuit.

Optionally, the writing portion 410 comprises a first transistor M1 and a second transistor M2, as illustrated in the specific embodiments shown in FIG. 3A, FIG. 3B, and FIG. 4 that follow.

A gate electrode of the first transistor M1 is electrically coupled to a first control terminal EN1, a first electrode of the first transistor M1 is electrically coupled to the data voltage terminal VDATA, and a second electrode of the first transistor M1 is electrically coupled to the first electrode of the storage capacitor C. A gate electrode of the second transistor M2 is electrically coupled to a second control terminal EN2, a first electrode of the second transistor M2 is electrically coupled to the first electrode of the storage capacitor C, and a second electrode of the second transistor M2 is electrically coupled to the reference voltage terminal VREF.

As such, under control of the first control terminal EN1, the first transistor M1 is configured to guide the electrical conductance between the data voltage terminal VDATA and the first electrode of the storage capacitor C depending on specific stage when driving the pixel circuit, whereas under control of the second control terminal EN2, the second transistor M2 is configured to guide the electrical conductance between the reference voltage terminal VREF and the first electrode of the storage capacitor C depending on specific stage when driving the pixel circuit.

As shown in FIG. 2B, the reading portion 420 is electrically coupled to the second electrode of the storage capacitor C, the first electrode of the driving transistor 100, and one terminal of the light-emitting sub-circuit 200. The reading portion 420 is configured to electrically conduct the first electrode of the driving transistor 100 with the one terminal of the light-emitting sub-circuit 200 and/or to electrically conduct the first electrode of the driving transistor 100 with the second electrode of the storage capacitor C depending on specific stages of driving the pixel circuit.

Optionally, the reading portion 410 comprises a third transistor M3 and a fourth transistor M4, as illustrated in the specific embodiment shown in FIG. 3A, FIG. 3B, and FIG. 4 that follow.

A gate electrode of the third transistor M3 is electrically coupled to a third control terminal EN3, a first electrode of the third transistor M3 is electrically coupled to the second electrode of the organic light-emitting diode OLED (i.e. the aforementioned one terminal of the light-emitting sub-circuit 200), and a second electrode of the third transistor M3 is electrically coupled to the first electrode of the driving transistor 100. A gate electrode of the fourth transistor M4 is electrically coupled to a fourth control terminal EN4, a first electrode of the fourth transistor M4 is electrically coupled to the second electrode of the storage capacitor C, and a second electrode of the fourth transistor M4 is electrically coupled to the first electrode of the driving transistor 100.

As such, under control of the third control terminal EN3, the third transistor M3 is configured to guide the electrical conductance between the first electrode of the driving transistor 100 with the one terminal of the light-emitting sub-circuit 200 depending on a specific stage of driving the pixel circuit, whereas under control of the fourth control terminal EN4, the fourth transistor M4 is configured to guide the electrical conductance between the first electrode of the driving transistor 100 with the second electrode of the storage capacitor C depending on a specific stage of driving the pixel circuit.

FIG. 3A illustrates a circuit diagram of a pixel circuit according to one specific embodiment of the disclosure.

In this specific embodiment of the pixel circuit as illustrated in FIG. 3A, the light-emitting sub-circuit 200 includes an organic light-emitting diode OLED, arranged such that a first electrode thereof is electrically coupled to the first power supply terminal VDD, and a second electrode thereof is electrically coupled to the compensation sub-circuit 400.

Further as illustrated in FIG. 3A, in the pixel circuit, the short-circuiting sub-circuit 300 comprises a short-circuiting transistor MS. A gate electrode of the short-circuiting transistor MS is electrically coupled to a short-circuiting control terminal ENS, a first electrode of the short-circuiting transistor MS is electrically coupled to the first electrode of the organic light-emitting diode OLED, and a second electrode of the short-circuiting transistor MS is electrically coupled to the second electrode of the organic light-emitting diode OLED.

In other words, a transistor (i.e. the short-circuiting transistor MS) that is electrically coupled to the two terminals of the light-emitting sub-circuit (i.e. the organic light-emitting diode OLED) can be configured as the short-circuiting sub-circuit 300 of the pixel circuit disclosed herein. As such, through a simple signal (i.e. a high electric potential) from the short-circuiting control terminal ENS that is applied to the gate electrode of the short-circuiting transistor MS, the short-circuiting sub-circuit 300 can be controlled fast and accurately to turn on to thereby short-circuit the two terminal of the organic light-emitting diode OLED.

In the embodiment of the pixel circuit as illustrated in FIG. 3A, the gate electrode of the driving transistor 100 (i.e. the driving transistor T in FIG. 3A) is electrically coupled to the compensation sub-circuit 400, the first electrode (i.e. a drain electrode) of the driving transistor 100 is electrically coupled to the compensation sub-circuit 400, and the second electrode (i.e. a source electrode) of the driving transistor 100 is electrically coupled to the second power supply terminal VSS.

In the pixel circuit, the compensation sub-circuit 400 comprises a storage capacitor C, a writing portion, and a reading portion. A second electrode of the storage capacitor C is electrically coupled to the gate electrode of the driving transistor 100.

As shown in FIG. 3A, the writing portion comprises a first transistor M1 and a second transistor M2. A gate electrode of the first transistor M1 is electrically coupled to a first control terminal EN1, a first electrode of the first transistor M1 is electrically coupled to the data voltage terminal VDATA, and a second electrode of the first transistor M1 is electrically coupled to the first electrode of the storage capacitor C. A gate electrode of the second transistor M2 is electrically coupled to a second control terminal EN2, a first electrode of the second transistor M2 is electrically coupled to the first electrode of the storage capacitor C, and a second electrode of the second transistor M2 is electrically coupled to the reference voltage terminal VREF.

The writing portion is configured to determine whether a signal from a data voltage terminal VDATA is guided into the first electrode of the storage capacitor C under control of the first control terminal EN1 or whether a signal from the reference voltage terminal VREF is guided into the first electrode of the storage capacitor C under control of the second control terminal EN2.

As also shown in FIG. 3A, the reading portion comprises a third transistor M3 and a fourth transistor M4. A gate electrode of the third transistor M3 is electrically coupled to a third control terminal EN3, a first electrode of the third transistor M3 is electrically coupled to the second electrode of the organic light-emitting diode OLED, and a second electrode of the third transistor M3 is electrically coupled to the first electrode of the driving transistor 100. Agate electrode of the fourth transistor M4 is electrically coupled to a fourth control terminal EN4, a first electrode of the fourth transistor M4 is electrically coupled to the second electrode of the storage capacitor C, and a second electrode of the fourth transistor M4 is electrically coupled to the first electrode of the driving transistor 100.

The reading portion is configured to electrically conduct the first electrode of the driving transistor 100 with the second electrode of the light-emitting diode OLED under control of the third control terminal EN3 and/or to electrically conduct the first electrode of the driving transistor 100 with the second electrode of the storage capacitor C under control of the fourth control terminal EN4.

Further as shown in FIG. 3A, the first electrode of the storage capacitor C, the second electrode of the first transistor M1 and the first electrode of the second transistor M2 are electrically connected at a node n1. The second electrode of the storage capacitor C, the first electrode of the fourth transistor M4, and the gate electrode of the driving transistor T are electrically connected at a node n2.

Optionally, the driving transistor 100 can be an N-type transistor.

Optionally, the first transistor M1, the second transistor M2, the third transistor M3, the fourth transistor M4, and the short-circuiting transistor MS are all N-type transistors or are all P-type transistors. That is, except the driving transistor 100, all other transistors (i.e. the first transistor M1, the second transistor M2, the third transistor M3, the fourth transistor M4, and the short-circuiting transistor MS) are of the same type (i.e. N-type or P-type), so that it is more convenient to manufacture the pixel circuit as described herein. However, it should be noted that, because all other transistors only function as switches, they may be of different types, so long as their types match the signals of the control terminals.

FIG. 4 illustrates a pixel circuit according to another embodiment of the disclosure. As shown in the figure, this embodiment of the pixel circuit further comprises a holding capacitor HC, which is arranged such that a first electrode of the holding capacitor HC is electrically coupled to the first electrode of the storage capacitor C, and a second electrode of the holding capacitor is electrically coupled to a ground terminal GROUND.

In other words, the first electrode of the holding capacitor HC is also electrically coupled to the n1 node, and the second electrode of the holding capacitor HC is electrically coupled to the ground terminal GROUND, as illustrated in FIG. 3B. It is noted that in this embodiment of the pixel circuit, the holding capacitor HC is substantially part of a compensation sub-circuit 400 of the pixel circuit.

In a second aspect, the present disclosure further provides a method for driving the above-described pixel circuit.

The driving method substantially comprises a compensation stage and a writing-and-illuminating stage. During the compensation stage, the short-circuiting sub-circuit is turned on so that the light-emitting sub-circuit is short-circuited and thus cannot emit a light. During the writing-and-illuminating stage, the gate electrode of the driving transistor 100 is loaded with the driving voltage that is related to the threshold voltage of the driving transistor 100, and the short-circuiting sub-circuit is turned off so that the light-emitting sub-circuit can emit a light.

In the following, the pixel circuit driving method as described above will be described in more detail with reference to the specific embodiment of the pixel circuit as shown in FIG. 3A. The driving time sequence diagram of the pixel circuit is further illustrated in FIG. 3B.

In this specific embodiment of the pixel circuit, the first transistor M1, the second transistor M2, the third transistor M3, the fourth transistor M4 and the short-circuiting transistor MS are all N-type transistors, the driving transistor 100 is an N-type transistor. In this case, a turning-on signal is a high electric potential signal, and a turning-off signal is a low electric potential signal.

It should be noted that, in another embodiment of the pixel circuit in which the first transistor M1, the second transistor M2, the third transistor M3, the fourth transistor M4 and the short-circuiting transistor MS are all P-type transistors, as long as the turning-on signal is a high electric potential signal, and the turning-off signal is a low electric potential signal, all states of the pixel circuit during all stages are substantially the same. As such, the description of the method for driving this embodiment of the pixel circuit is skipped herein.

Specifically, in the driving method of the pixel circuit as described above and illustrated in FIG. 3A, the specific signals of the first power supply terminal VDD and the second power supply terminal VSS are determined based on the direction in which the organic light-emitting diode OLED is connected in the pixel circuit.

For example, if the first electrode of the organic light-emitting diode OLED is an anode, and the second electrode of the organic light-emitting diode OLED is a cathode, then the first power supply terminal VSS shall continuously provide a high-potential power supply voltage Vdd, whereas the second power supply terminal VSS shall continuously provide a low-potential signal. In one specific example, the second power supply terminal VSS can be electrically coupled to the ground, thus can provide 0 V signals.

In the following, the configuration as mentioned above will be used as an example for the detailed description of the pixel circuit and its driving method disclosed herein. It is noted, however, this above example serves as an illustrating purpose only, and shall not be interpreted to impose a limitation to the scope of the disclosure.

Specifically, the driving method of the pixel circuit can comprise a compensation stage S1 and a writing-and-illuminating stage S2, as illustrated by the driving time sequence diagram of the pixel circuit as shown in FIG. 3B.

The compensation stage S1 specifically comprises a resetting sub-stage S11 and a testing sub-stage S12.

Specifically as illustrated in FIG. 3B, the resetting sub-stage S11 of the compensation stage S1 comprises: providing a high electric potential (i.e. a turning-on signal, which will be the same and will not be repeated hereafter) to the short-circuiting control terminal ENS, providing a low electric potential (i.e. a turning-off signal, which will be the same and will not be repeated hereafter) to the first control terminal EN1, providing a high electric potential to the second control terminal EN2, providing a high electric potential to the third control terminal EN3, and providing a high electric potential to the fourth control terminal EN4. The equivalent circuit diagram of the pixel circuit is illustrated by the dotted line as illustrated in FIG. 5A.

Figure 5A:
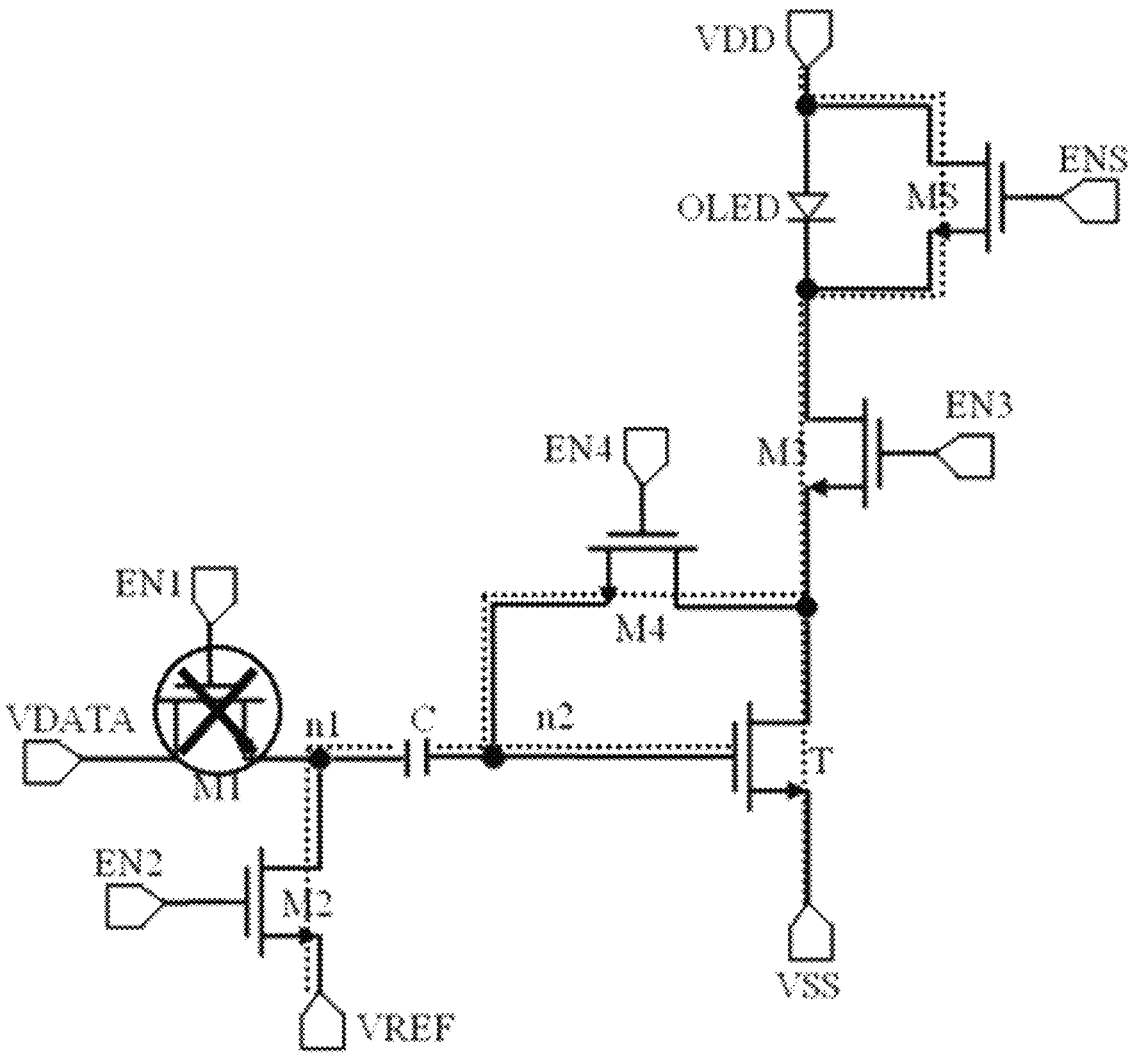
FIG. 5A is a circuit diagram of the pixel circuit as illustrated in FIG. 3A during the resetting sub-stage of the compensation stage of the pixel circuit.

Specifically, as shown in FIG. 5A, during the resetting sub-stage S11 of the compensation stage S1 of the pixel circuit, the first control terminal EN1 is at a low electrical potential, thus the first transistor M1 is turned off (as illustrated by the cross sign in FIG. 5A), and thereby there is no electrical connection between the data voltage Vdata of the data voltage terminal VDATA and the n1 node.

At the same time, the second control terminal EN2 is at a high electrical potential. As such, the second transistor M2 is turned on, and the reference voltage Vref at the reference voltage terminal VREF is thereby guided to the n1 node, and the voltage at the n1 node is substantially equal to the reference voltage Vref at the reference voltage terminal VREF, expressed as:

$$Vn1=Vref.$$

At the same time, the short-circuiting control terminal ENS, the third control terminal EN3, and the fourth control terminal EN4 are all at a high electric potential, thus each of the short-circuiting transistor MS, the third transistor M3, and the fourth transistor M4 is turned on. Therefore, the first power supply voltage Vdd from the first power supply terminal VDD is guided to the n2 node, and the voltage at the n2 node is substantially equal to the first power supply voltage Vdd from the first power supply terminal VDD, expressed as:

$$Vn2=Vdd.$$

As such, the storage capacitor C is reset.

Specifically, as illustrated in FIG. 3B, the testing sub-stage S12 of the compensation stage S1 comprises: providing a high electric potential to the short-circuiting control terminal ENS, providing a low electric potential to the first control terminal EN1, providing a high electric potential to the second control terminal EN2, providing a low electric potential to the third control terminal EN3, and providing a high electric potential to the fourth control terminal EN4. The equivalent circuit diagram of the pixel circuit is illustrated by the dotted line as illustrated in FIG. 5B.

Figure 5B:
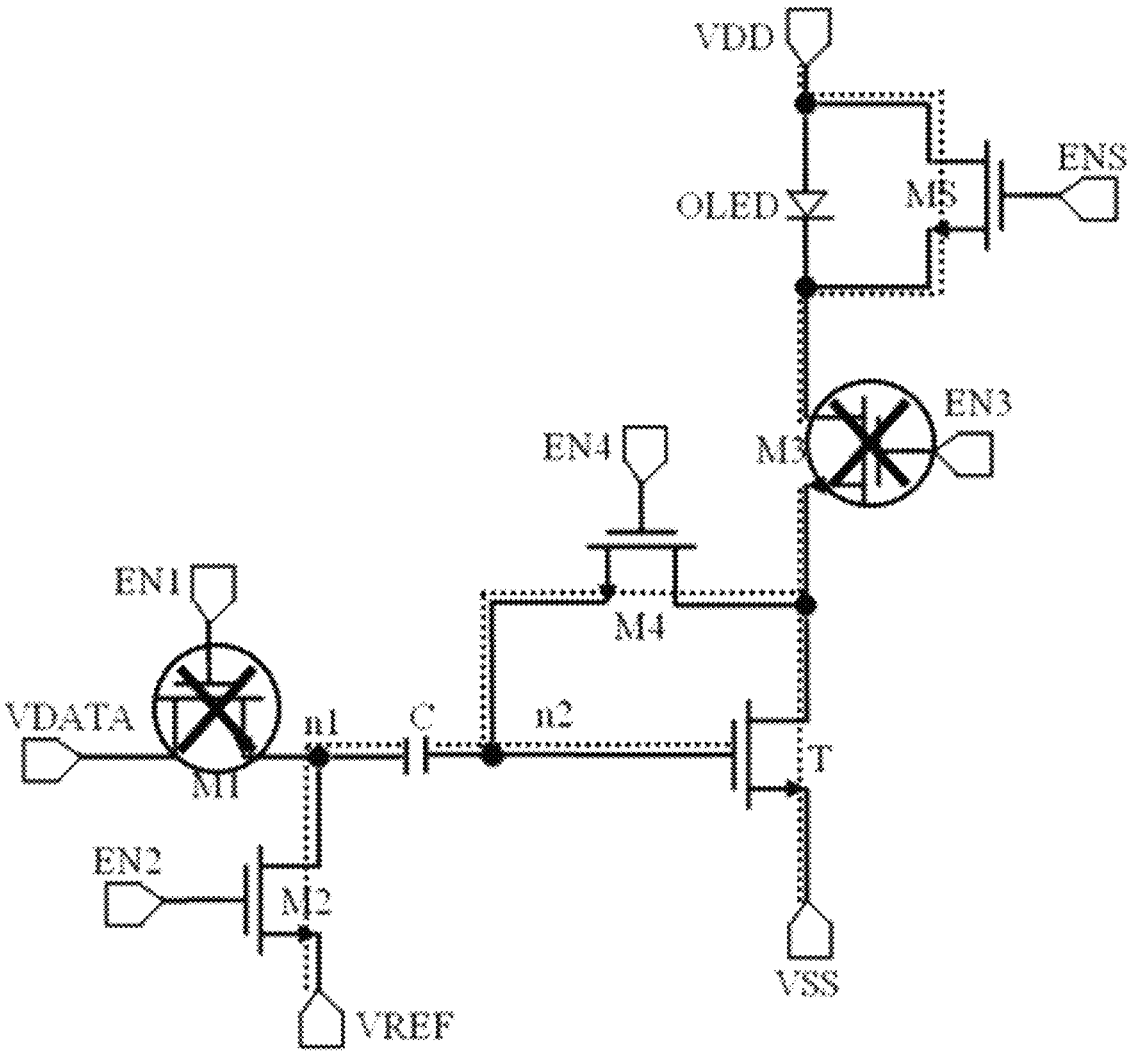
FIG. 5B is a circuit diagram of the pixel circuit as illustrated in FIG. 3A during the testing sub-stage of the compensation stage of the pixel circuit.

Specifically, as illustrated in FIG. 5B, during the testing sub-stage S12 of the pixel circuit, each of the short-circuiting control terminal ENS, the second control terminal EN2, and the fourth control terminal EN4 remains at a high electric potential, just like the resetting sub-stage S11, thus each of the short-circuiting transistor MS, the second transistor M2, and the fourth transistor M4 remains turned on as the resetting sub-stage S11. At the same time, the first control terminal EN1 remains at a low electrical potential and thus the first transistor M1 remains turned off. However, the third control terminal EN3 is altered from a high electric potential in the resetting sub-stage S11 to a low electric potential in the testing sub-stage S12, thus the third transistor M3 is turned off.

Because the fourth transistor M4 remains turned on at the test sub-stage S12, the driving transistor T becomes substantially equivalent to a diode, its gate-source voltage Vgs is substantially equal to its threshold voltage Vth, i.e., $$Vgs=Vth.$$

The value of the gate-source voltage Vgs is substantially equal to a difference of values between the voltage at the n2 node (i.e. the voltage at the gate electrode and at the first electrode/source electrode) and the voltage at the second voltage terminal VSS (i.e. the voltage at the source electrode).

In this embodiment of the pixel circuit, because the second voltage terminal VSS is electrically coupled to the ground, the voltage is 0 V, $$Vn2=Vth.$$

At this time, the value of Vn1 is still equal to the value of Vref.

From the equivalent circuit diagrams as illustrated in FIG. 5A and FIG. 5B, it can be seen that, during the resetting sub-stage S11 and the testing sub-stage S12 of the compensation stage S1, the organic light-emitting diode OLED is always short-circuited by the short-circuiting sub-circuit due to the turning-on of the short-circuiting transistor MS. Therefore, no matter how the compensation process is, the organic light-emitting diode OLED does not emit lights, thus there is no limitation to the range of compensation provided by the pixel circuit as described above.

The writing and illuminating stage S2 specifically can comprise a writing sub-stage S21 and an illuminating sub-stage S22, as illustrated in FIG. 3B.

Specifically, the writing sub-stage S21 comprises: providing a low electric potential to the short-circuiting control terminal ENS, providing a high electric potential to the first control terminal EN1, providing a low electric potential to the second control terminal EN2, providing a high electric potential to the third control terminal EN3, and providing a low electric potential to the fourth control terminal EN4. The equivalent circuit diagram of the pixel circuit is illustrated by the dotted line as illustrated in FIG. 5C.

Figure 5C:
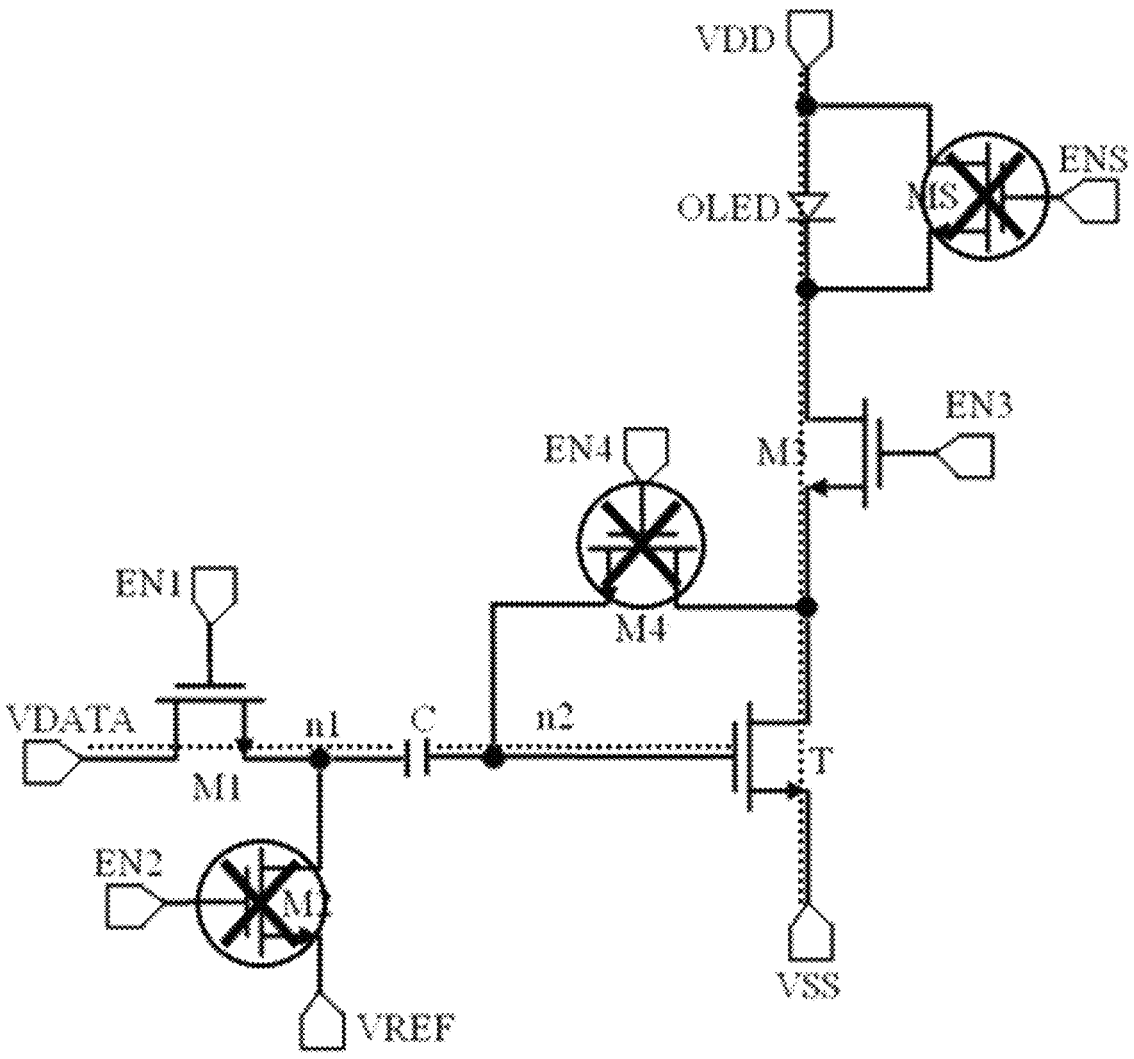
FIG. 5C is a circuit diagram of the pixel circuit as illustrated in FIG. 3A during the writing sub-stage of the writing and illuminating stage of the pixel circuit.

Specifically, as illustrated in FIG. 5C, because of the signals provided by the various terminals as described above, the short-circuiting transistor MS is turned off, the first transistor M1 is turned on, the second transistor M2 is turned off, the third transistor M3 is turned on, and the fourth transistor M4 is turned off during the writing sub-stage S21 of the pixel circuit.

During this writing sub-stage S21 of the writing and illuminating stage S2, due to the turning-on of the first transistor M1 and the turning-off of the second transistor M2, the data voltage Vdata of the data voltage terminal VDATA, rather than the reference voltage Vref at the reference voltage terminal VREF during both the resetting sub-stage S11 and the testing sub-stage S12 of the compensation stage S, can be guided to the n1 node, and the voltage at the n1 node:

$$Vn1=V\text{data}.$$

As such, the corresponding change of Vn1:

$$\Delta Vn1=V\text{data}-V\text{ref}.$$

At the same time, due to the turning-off of the fourth control terminal EN4, the n2 node cannot discharge electricity. Because of the bootstrap effect of the storage capacitor C, its voltage will be changed in the same way as the n1 node, and the voltage at the n2 node:

$$Vn2=Vth+V\text{data}-V\text{ref}.$$

At the same time, because the short-circuiting control terminal ENS is changed to a low electric potential, the short-circuiting transistor MS is turned off, thus the organic light-emitting diode OLED is not short-circuited, and is thereby allowed to emit lights. At this time, the voltage at the n2 node, which is also the voltage of the gate electrode of the driving transistor 100:

$$Vn2=Vth+V\text{data}-V\text{ref}.$$

Herein Vn2 is substantially the driving voltage for the driving transistor 100, and is related to Vth. The current flowing through the driving transistor 100 is proportional of $(Vgs-Vth)^2$, expressed as:

$$I_{DS}=\frac{1}{2}\mu_n C_O\frac{W}{L}(V_d-V_{th})^2$$

Herein $I_{DS}$ is the current running through the light-emitting diode OLED, $\mu_n$ is the transfer rate of carriers driving in the light-emitting diode OLED, W and L are respectively the width and length of the channel layer of the light-emitting diode OLED.

Because:

$$\text{Thus}: Vgs=Vn2-0V=Vth+Vdata-Vref;$$

$$(Vgs-Vth)^2=(Vdata-Vref)^2.$$

$$I_{DS}=\frac{1}{2}\mu_n C_O\frac{W}{L}(V_d-V_r)^2$$

As such, the current flowing through the driving transistor 100 is no longer related to Vth. That is, the level of the brightness of the light emitted by the organic light-emitting diode OLED is not related to Vth, but is instead controlled by the data voltage Vdata. Thereby the compensation is accomplished.

Specifically, as illustrated in FIG. 3B, the illuminating sub-stage S22 comprises: providing a low electric potential to the short-circuiting control terminal ENS, providing a low electric potential to the first control terminal EN1, providing a low electric potential to the second control terminal EN2, providing a high electric potential to the third control terminal EN3, providing a low electric potential to the fourth control terminal EN4. The equivalent circuit diagram of the pixel circuit is illustrated by the dotted line as illustrated in FIG. 5D.

Figure 5D:
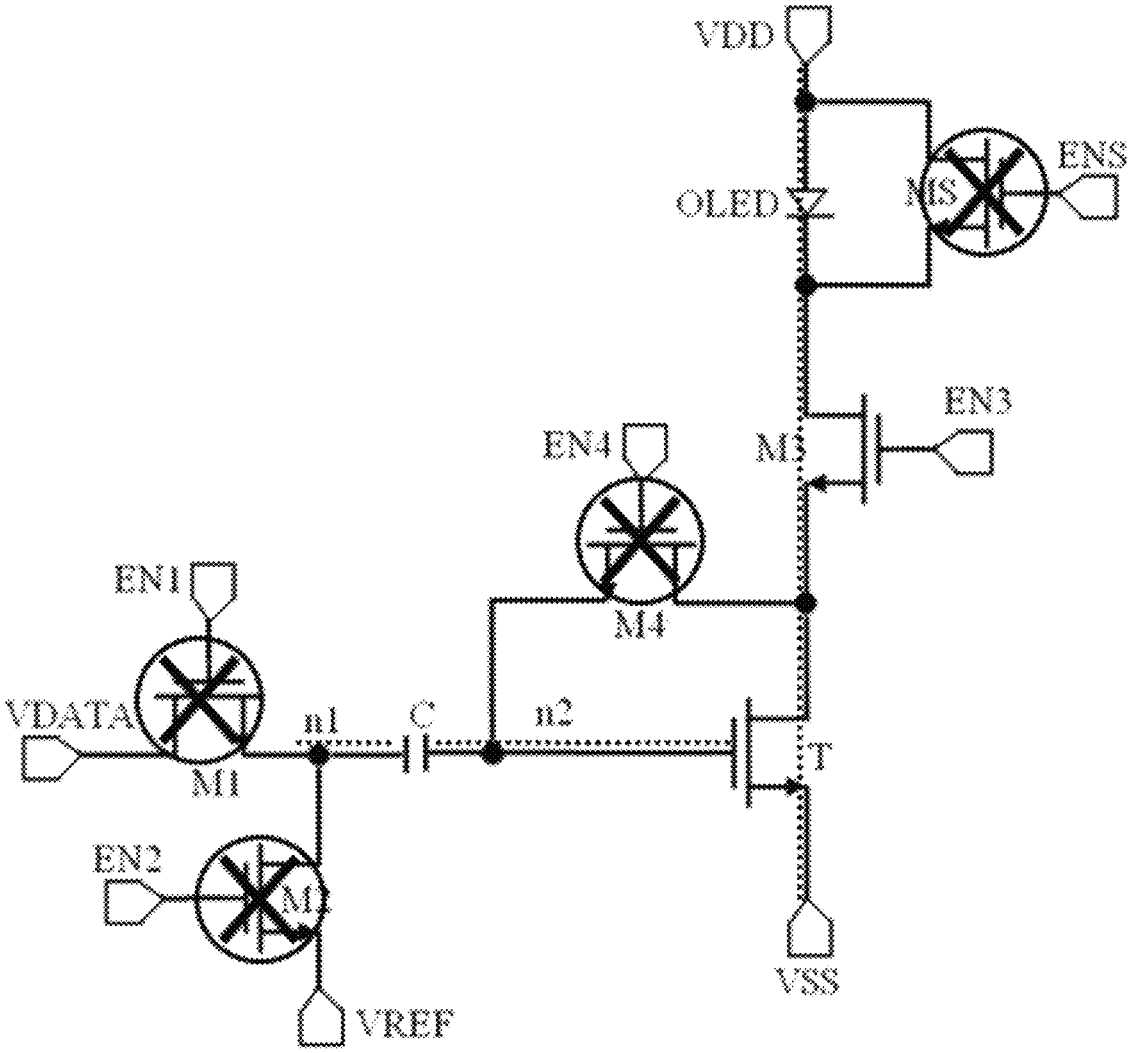
FIG. 5D is a circuit diagram of the pixel circuit as illustrated in FIG. 3A during the illuminating sub-stage of the writing and illuminating stage of the pixel circuit.

Specifically, as illustrated in FIG. 5D, because of the signals provided by the various terminals as described above, the short-circuiting transistor MS is turned off, the first transistor M1 is turned off, the second transistor M2 is turned off, the third transistor M3 is turned on, and the fourth transistor M4 is turned off during the illuminating sub-stage S22 of the pixel circuit.

During this stage, the first control terminal EN1 is changed to a low electric potential, signals are no longer written into the data control terminal VDATA. Herein, a data line that is electrically coupled or connected to the data control terminal VDATA is configured to provide data signals for pixel units on other lines. The voltage at the n1 node (i.e. Vn1) and the voltage at the n2 node (i.e. Vn2) do not change, the light-emitting diode OLED emits light continuously during the illuminating sub-stage S21 until the resetting sub-stage S11 of the compensation stage S1 is entered again.

It is further noted that in embodiments where a holding capacitor as described above is in the circuit, and the holding capacitor is arranged to have its first electrode and its second electrode electrically coupled to the first electrode of the storage capacitor C and the ground terminal, respectively, as illustrated in FIG. 4, the voltage at the n1 node Vn1 can be maintained more stably unchanged, which in turn can also improve the stability of the voltage at the n2 node Vn2. Yet in the present disclosure, the holding capacitor is optional.

As can be seen in the various stages and sub-stages of the driving method of the pixel circuit as described above, the signals of the second control terminal EN2 and the signals of the fourth control terminal EN4 are always substantially the same. As such, these two terminals can indeed be merged according to some other embodiments of the disclosure, that is, the gate electrode of the second transistor M2 and the gate electrode of the fourth transistor M4 can be electrically coupled to a same terminal provided with a substantially same signal as the second control terminal EN2 or the fourth control terminal EN4 in the embodiments as described above.

In a third aspect, the disclosure further provides a display apparatus.

The display apparatus comprises a plurality of pixel circuits, and each pixel circuit is substantially based on any of the embodiments of the pixel circuit as described above.

Specifically, the display apparatus disclosed herein can be any electronic products or electronic components having a display functionality, such as organic light-emitting diode display panels, electronic papers, mobile phones, tablets, televisions, monitors, laptops, digital photo frames and navigators.

Although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the exemplary embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

The invention claimed is:

1. A pixel circuit, comprising a driving transistor, a light-emitting sub-circuit, a short-circuiting sub-circuit, and a compensation sub-circuit, wherein:

a first terminal and a second terminal of the light-emitting sub-circuit are electrically coupled to a first power supply terminal and the compensation sub-circuit respectively;

the short-circuiting sub-circuit is electrically coupled to the first terminal and the second terminal of the light-emitting sub-circuit, and is configured to short-circuit the light-emitting sub-circuit under control of a short-circuiting control terminal;

the compensation sub-circuit, having a plurality of transistors, wherein the compensation sub-circuit is electrically coupled to a data voltage terminal, a reference voltage terminal, and a first electrode and a gate electrode of the driving transistor, where only a first electrode of a single transistor of the plurality of transistors is directly connected to the light-emitting sub-circuit and the short-circuiting sub-circuit; and a second electrode of the driving transistor is electrically coupled to a second power supply terminal;

wherein:

the light-emitting sub-circuit is configured to emit a light of brightness in a level corresponding to a current flowing therethrough; and the compensation sub-circuit is configured, based on the data voltage terminal and the reference voltage terminal, to load a driving voltage related to a threshold voltage of the driving transistor onto the gate electrode of the driving transistor, such that a current flowing through the driving transistor is not influenced by the threshold voltage of the driving transistor.

2. The pixel circuit of claim 1, wherein the short-circuiting sub-circuit comprises a short-circuiting transistor, wherein:

a gate electrode, a first electrode and a second electrode thereof are electrically coupled to the short-circuiting control terminal, the first terminal, and the second terminal of the light-emitting sub-circuit, respectively; and the short-circuiting transistor is configured to electrically conduct the first terminal and the second terminal of the light-emitting sub-circuit upon a turning-on signal from the short-circuiting control terminal.

3. The pixel circuit of claim 1, wherein the compensation sub-circuit comprises a storage capacitor, a writing portion, and a reading portion, wherein:

a first electrode and a second electrode of the storage capacitor are electrically coupled to the writing portion and the gate electrode of the driving transistor, respectively;

the writing portion is electrically coupled to the data voltage terminal and the reference voltage terminal, and the writing portion is configured to guide a signal from the data voltage terminal, and to guide a signal from the reference voltage terminal, to the first electrode of the storage capacitor; and the reading portion is electrically coupled to the second electrode of the storage capacitor, the first electrode of the driving transistor, and the second terminal of the light-emitting sub-circuit, and the reading portion is configured to electrically conduct the first electrode of the driving transistor with the second terminal of the light-emitting sub-circuit, and to electrically conduct the first electrode of the driving transistor with the second electrode of the storage capacitor.

4. The pixel circuit of claim 3, wherein the writing portion comprises a first transistor and a second transistor, wherein:

the first transistor is arranged such that a gate electrode, a first electrode and a second electrode thereof are electrically coupled to a first control terminal, the data voltage terminal, and the first electrode of the storage capacitor respectively, and the first transistor is configured to electrically conduct the data voltage terminal and the first electrode of the storage capacitor upon a turning-on signal from the first control terminal; and the second transistor is arranged such that a gate electrode, a first electrode and a second electrode thereof are electrically coupled to a second control terminal, the first electrode of the storage capacitor, and the reference voltage terminal respectively, and the second transistor is configured to electrically conduct the reference voltage terminal and the first electrode of the storage capacitor upon a turning-on signal from the second control terminal.

5. The pixel circuit of claim 3, wherein the reading portion comprises a third transistor and a fourth transistor, wherein:

the third transistor is arranged such that a gate electrode, a first electrode and a second electrode thereof are electrically coupled to a third control terminal, the second terminal of the light-emitting sub-circuit, and the first electrode of the driving transistor respectively, and the third transistor is configured to electrically conduct the second terminal of the light-emitting sub-circuit, and the first electrode of the driving transistor upon a turning-on signal from the third control terminal; and the fourth transistor is arranged such that a gate electrode, a first electrode and a second electrode thereof are electrically coupled to a fourth control terminal, the second electrode of the storage capacitor, and the first electrode of the driving transistor respectively, and the fourth transistor is configured, upon a turning-on signal from the fourth control terminal, to electrically conduct the second electrode of the storage capacitor and the first electrode of the driving transistor to thereby electrically conduct the gate electrode and the first electrode of the driving transistor.

6. The pixel circuit of claim 3, wherein the compensation sub-circuit further comprises a holding capacitor, wherein a first electrode and a second electrode of the holding capacitor are electrically coupled to the first electrode of the storage capacitor and a ground terminal respectively.

7. The pixel circuit of claim 1, wherein the driving transistor is a N-type transistor.

8. The pixel circuit of claim 1, wherein each of the short-circuiting sub-circuit and the compensation sub-circuit comprise at least one transistor, wherein each of the at least one transistor is of a substantially same type.

9. The pixel circuit of claim 8, wherein each of the at least one transistor is a N-type transistor.

10. The pixel circuit of claim 1, wherein the second power supply terminal is grounded.

11. The pixel circuit of claim 1, wherein the light-emitting sub-circuit comprises an organic light-emitting diode (OLED).

12. A method for driving a pixel circuit according to claim 1, comprising:

a compensation stage, when the short-circuiting sub-circuit is turned on so that the light-emitting sub-circuit is short-circuited and thereby cannot emit a light; and a writing-and-illuminating stage, when the short-circuiting sub-circuit is turned off so that the light-emitting sub-circuit can emit a light, and the gate electrode of the driving transistor is loaded with the driving voltage such that the current flowing therethrough is not influenced by the threshold voltage of the driving transistor.

13. The method according to claim 12, wherein the short-circuiting sub-circuit comprises a short-circuiting transistor, arranged such that a gate electrode, a first electrode and a second electrode thereof are electrically coupled to the short-circuiting control terminal, the first terminal and the second terminal of the light-emitting sub-circuit respectively, and configured to electrically conduct the first terminal and the second terminal of the light-emitting sub-circuit upon a turning-on signal from the short-circuiting control terminal, wherein:

the compensation stage comprises: providing the turning-on signal to the short-circuiting control terminal; and the writing-and-illuminating stage comprises: providing a turning-off signal to the short-circuiting control terminal.

14. The method according to claim 12, wherein the compensation sub-circuit comprises a storage capacitor, a writing portion, and a reading portion, wherein a first electrode and a second electrode of the storage capacitor are electrically coupled to the writing portion and the gate electrode of the driving transistor respectively, the writing portion is electrically coupled to the data voltage terminal and the reference voltage terminal, and the reading portion is electrically coupled to the second electrode of the storage capacitor, the first electrode of the driving transistor and the second terminal of the light-emitting sub-circuit, wherein:

the compensation stage comprises:

a resetting sub-stage, comprising: electrically decoupling the data voltage terminal to the first electrode of the storage capacitor, electrically conducting the reference voltage terminal to the first electrode of the storage capacitor, electrically conducting the first electrode of the driving transistor with the second terminal of the light-emitting sub-circuit, and electrically conducting the first electrode of the driving transistor with the second electrode of the storage capacitor; and a testing sub-stage, comprising: electrically decoupling the data voltage terminal to the first electrode of the storage capacitor, electrically conducting the reference voltage terminal to the first electrode of the storage capacitor, electrically decoupling the first electrode of the driving transistor with the second terminal of the light-emitting sub-circuit, and electrically conducting the first electrode of the driving transistor with the second electrode of the storage capacitor;

and the writing-and-illuminating stage comprises:

a writing sub-stage, comprising: electrically conducting the data voltage terminal to the first electrode of the storage capacitor, electrically decoupling the reference voltage terminal to the first electrode of the storage capacitor, electrically conducting the first electrode of the driving transistor with the second terminal of the light-emitting sub-circuit, and electrically decoupling the first electrode of the driving transistor with the second electrode of the storage capacitor; and an illuminating stage, comprising: electrically decoupling the data voltage terminal or the reference voltage terminal to the first electrode of the storage capacitor, electrically decoupling the reference voltage terminal to the first electrode of the storage capacitor, electrically conducting the first electrode of the driving transistor with the second terminal of the light-emitting sub-circuit, and electrically decoupling the first electrode of the driving transistor with the second electrode of the storage capacitor.

15. The method of claim 14, wherein the writing portion comprises a first transistor and a second transistor, wherein the first transistor is arranged such that a gate electrode, a first electrode and a second electrode thereof are electrically coupled to a first control terminal, the data voltage terminal, and the first electrode of the storage capacitor respectively, and is configured to electrically conduct the data voltage terminal and the first electrode of the storage capacitor upon a turning-on signal from the first control terminal; and the second transistor is arranged such that a gate electrode, a first electrode and a second electrode thereof are electrically coupled to a second control terminal, the first electrode of the storage capacitor, and the reference voltage terminal respectively, and is configured to electrically conduct the reference voltage terminal and the first electrode of the storage capacitor upon a turning-on signal from the second control terminal, wherein:

said electrically conducting the data voltage terminal to the first electrode of the storage capacitor comprises providing a turning-on signal to the first control terminal;

the electrically decoupling the data voltage terminal to the first electrode of the storage capacitor comprises providing a turning-off signal to the first control terminal;

the electrically conducting the reference voltage terminal to the first electrode of the storage capacitor comprises providing the turning-on signal to the second control terminal; and the electrically decoupling the reference voltage terminal to the first electrode of the storage capacitor comprises providing a turning-off signal to the second control terminal.

16. The method of claim 14, wherein the reading portion comprises a third transistor and a fourth transistor, wherein the third transistor is arranged such that a gate electrode, a first electrode and a second electrode thereof are electrically coupled to a third control terminal, the second terminal of the light-emitting sub-circuit, and the first electrode of the driving transistor respectively, and is configured to electrically conduct the second terminal of the light-emitting sub-circuit, and the first electrode of the driving transistor upon a turning-on signal from the third control terminal, and the fourth transistor is arranged such that a gate electrode, a first electrode and a second electrode thereof are electrically coupled to a fourth control terminal, the second electrode of the storage capacitor, and the first electrode of the driving transistor respectively, and is configured, upon a turning-on signal from the fourth control terminal, to electrically conduct the second electrode of the storage capacitor and the first electrode of the driving transistor to thereby electrically conduct the gate electrode and the first electrode of the driving transistor, wherein:

said electrically conducting the first electrode of the driving transistor with the second terminal of the light-emitting sub-circuit comprises providing the turning-on signal to the third control terminal;

the electrically decoupling the first electrode of the driving transistor with the second terminal of the light-emitting sub-circuit comprises providing a turning-off signal to the third control terminal;

the electrically conducting the first electrode of the driving transistor with the second electrode of the storage capacitor comprises providing the turning-on signal to the fourth control terminal; and the electrically decoupling the first electrode of the driving transistor with the second electrode of the storage capacitor comprises providing a turning-off signal to the fourth control terminal.

17. A display apparatus, comprising a pixel circuit according to claim 1.

18. The display apparatus of claim 17, wherein the short-circuiting sub-circuit comprises a short-circuiting transistor, wherein:

a gate electrode, a first electrode and a second electrode thereof are electrically coupled to the short-circuiting control terminal, the first terminal, and the second terminal of the light-emitting sub-circuit, respectively; and the short-circuiting transistor is configured to electrically conduct the first terminal and the second terminal of the light-emitting sub-circuit upon a turning-on signal from the short-circuiting control terminal.

19. The display apparatus of claim 17, wherein the compensation sub-circuit comprises a storage capacitor, a writing portion, and a reading portion, wherein:

a first electrode and a second electrode of the storage capacitor are electrically coupled to the writing portion and the gate electrode of the driving transistor, respectively;

the writing portion is electrically coupled to the data voltage terminal and the reference voltage terminal, and the writing portion is configured to guide a signal from the data voltage terminal, and to guide a signal from the reference voltage terminal, to the first electrode of the storage capacitor; and the reading portion is electrically coupled to the second electrode of the storage capacitor, the first electrode of the driving transistor, and the second terminal of the light-emitting sub-circuit, and the reading portion is configured to electrically conduct the first electrode of the driving transistor with the second terminal of the light-emitting sub-circuit, and to electrically conduct the first electrode of the driving transistor with the second electrode of the storage capacitor.

20. The display apparatus of claim 19, wherein the writing portion comprises a first transistor and a second transistor, wherein:

the first transistor is arranged such that a gate electrode, a first electrode and a second electrode thereof are electrically coupled to a first control terminal, the data voltage terminal, and the first electrode of the storage capacitor respectively, and the first transistor is configured to electrically conduct the data voltage terminal and the first electrode of the storage capacitor upon a turning-on signal from the first control terminal; and the second transistor is arranged such that a gate electrode, a first electrode and a second electrode thereof are electrically coupled to a second control terminal, the first electrode of the storage capacitor, and the reference voltage terminal respectively, and the second transistor is configured to electrically conduct the reference voltage terminal and the first electrode of the storage capacitor upon a turning-on signal from the second control terminal.

* * * * *